US007083379B2

(12) United States Patent
Nikpour et al.

(10) Patent No.: US 7,083,379 B2
(45) Date of Patent: Aug. 1, 2006

(54) COMPRESSOR

(75) Inventors: Bahram Nikpour, Huddersfield (GB); Andrew Day, Golcar (GB); Roy Saxton, Meltham (GB); John Bywater, Crosland Moor (GB)

(73) Assignee: Holset Engineering Company, Limited (GB)

( * ) Notice: Subject to any disclaimer, the term of this patent is extended or adjusted under 35 U.S.C. 154(b) by 4 days.

(21) Appl. No.: 10/806,715

(22) Filed: Mar. 23, 2004

(65) Prior Publication Data

US 2005/0002782 A1 Jan. 6, 2005

(30) Foreign Application Priority Data

Apr. 30, 2003 (GB) ..... 0309893.6

(51) Int. Cl.
*F04D 29/66* (2006.01)

(52) U.S. Cl. ..... 415/56.5; 415/58.4; 415/144

(58) Field of Classification Search ..... 415/143, 415/144, 53.3, 56.5, 57.1, 58.3, 58.4, 58.7, 415/151, 162, 153.2, 159, 160, 206, 203
See application file for complete search history.

(56) References Cited

U.S. PATENT DOCUMENTS 4,503,684 A 3/1985 Mount et al.
4,721,435 A 1/1988 Kuah
4,743,161 A 5/1988 Fisher et al.
4,834,611 A * 5/1989 Meng ..... 415/58.5

FOREIGN PATENT DOCUMENTS

| | | |
|---|---|---|
| GB | 544440 | 4/1942 |
| GB | 940922 | 11/1963 |
| GB | 2202585 | 9/1988 |
| GB | 2319809 | 6/1998 |

* cited by examiner

*Primary Examiner*—Edward K. Look
*Assistant Examiner*—Dwayne J White
(74) *Attorney, Agent, or Firm*—Krieg DeVault LLP

(57) ABSTRACT

A compressor for compressing a gas comprises an impeller wheel (1) including a plurality of vanes (4) rotatably mounted within a housing (2). The housing (2) has an inner wall defining a surface (5) located in close proximity to radially outer edges (4*a*) of impeller vanes (4). The compressor inlet comprises an outer tubular wall (7) extending forming a gas intake and an inner tubular wall (8) extending within the outer tubular wall (7) and defining an inducer portion (10) of the inlet. An annular gas flow passage (11) is defined between the inner and outer tubular walls. There is at least one downstream aperture (13) communicating between the annular flow passage (11) and the surface (5) of the housing (2) swept by the impeller vanes (4) and at least one upstream aperture communicating between the annular flow passage (11) and the inducer or intake portions of the inlet. A plurality of inlet guide vanes (14) are mounted within the inducer portion (10) of the inlet downstream of the at least one upstream aperture to induce pre-swirl in gas flowing through the inducer portion of the inlet.

14 Claims, 8 Drawing Sheets

COMPRESSOR

The present application claims priority to British Patent Application No. 0309893.6, filed Apr. 30, 2003, which is incorporated herein by reference.

The present invention relates to a compressor. In particular, the invention relates to the inlet arrangement of a centrifugal compressor such as, for example, the compressor of a turbocharger.

A compressor comprises an impeller wheel, carrying a plurality of blades (or vanes) mounted on a shaft for rotation within a compressor housing. Rotation of the impeller wheel causes gas (e.g. air) to be drawn into the impeller wheel and delivered to an outlet chamber or passage. In the case of a centrifugal compressor the outlet passage is in the form of a volute defined by the compressor housing around the impeller wheel and in the case of an axial compressor the gas is discharged axially.

In a conventional turbocharger the impeller wheel is mounted to one end of a turbocharger shaft and is rotated by an exhaust driven turbine wheel mounted within a turbine housing at the other end of the turbocharger shaft. The shaft is mounted for rotation on bearing assemblies housed within a bearing housing positioned between the compressor and turbine housings.

In some turbochargers the compressor inlet has a structure that has become known as a "a map width enhanced" (MWE) structure. An MWE structure is described for instance in U.S. Pat. No. 4,743,161. The inlet of such an MWE compressor comprises two coaxial tubular inlet sections, an outer inlet section or wall forming the compressor intake and an inner inlet section or wall defining the compressor inducer, or main inlet. The inner inlet section is shorter than the outer inlet section and has an inner surface which is an extension of a surface of an inner wall of the compressor housing which is swept by edges of the impeller wheel blades. The arrangement is such that an annular flow path is defined between the two tubular inlet sections which is open at its upstream end and which is provided with apertures at its downstream end which communicate with the inner surface of the compressor housing which faces the impeller wheel.

In operation, the pressure within the annular flow passage surrounding the compressor inducer is normally lower than atmospheric pressure and during high gas flow and high speed operation of the impeller wheel the pressure in the area swept by the impeller wheel is less than that in the annular passage. Thus, under such conditions air flows inward from the annular passage to the impeller wheel thereby increasing the amount of air reaching the impeller wheel, and increasing the maximum flow capacity of the compressor. However, as the flow through the impeller wheel drops, or as the speed of the impeller wheel drops, so the amount of air drawn into the impeller wheel through the annular passage decreases until equilibrium is reached. A further drop in the impeller wheel flow or speed results in the pressure in the area swept by the impeller wheel increasing above that within the annular passage and thus there is a reversal in the direction of air flow through the annular passage. That is, under such conditions air flows outward from the impeller wheel to the upstream end of the annular passage and is returned to the compressor intake for recirculation. Increase in compressor gas flow or speed of the impeller wheel causes the reverse to happen, i.e. a decrease in the amount of air returned to the intake through the annular passage, followed by equilibrium, in turn followed by reversal of the air flow through the annular passage so that air is drawn in to the impeller wheel via the apertures communicating between the annular passage and the impeller.

It is well known that this arrangement stabilises the performance of the compressor increasing the maximum flow capacity and improving the surge margin, i.e. decreasing the flow at which the compressor surges. This is known as increasing the width of the compressor "map", which is a plot of the compressor characteristic. All of this is well known to the skilled person.

Compressor operation is extremely unstable under surge conditions due to large fluctuations in pressure and mass flow rate through the compressor. Many applications, such as in a turbocharger where the compressor supplies air to a reciprocating engine these fluctuations in mass flow rate are unacceptable. As a result there is a continuing requirement to extend the usable flow range of compressors by improving the surge margin.

It is an object of the present invention to provide a compressor inlet structures which improves upon the surge margin of a conventional MWE compressor.

According to the present invention there is provided a compressor for compressing a gas, the compressor comprising:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall extending away from the impeller wheel in an upstream direction within the outer tubular wall and defining an inducer portion of the inlet;

an annular gas flow passage defined between the inner and outer tubular walls;

at least one downstream aperture communicating between a downstream portion of the annular flow passage and said surface of the housing swept by the impeller vanes;

at least one upstream aperture communicating between an upstream portion of the annular flow passage and the inducer or intake portions of the inlet; and a plurality of inlet guide vanes mounted within the inducer portion of the inlet downstream of said at least one upstream aperture to induce pre-swirl in gas flowing through the inducer portion of the inlet.

The compressor according to the present invention has an improved surge margin in comparison with a conventional MWE compressor but does not suffer significant reduction in choke flow which is normally associated with a compressor fitted with an inlet guide vane system.

The angle of the inlet guide vanes is preferably between 0° and about 45° and may be fixed or variable.

Preferably the inner tubular wall extends upstream of said at least one downstream aperture by a length L2 measured along its axis, where L2/D is >0.6, where D is a diameter of the inner tubular wall.

In addition, it is preferable that the annular gas flow passage has a length L1 measured between its upstream and downstream ends which is such that L1/D is >0.65.

The compressor according to the present invention is suited for inclusion in a turbocharger.

Other preferred and advantageous features of the invention will be apparent from the following description.

A specific embodiment of the present invention will now be described, with reference to the accompanying drawings, in which.

Figure 2:
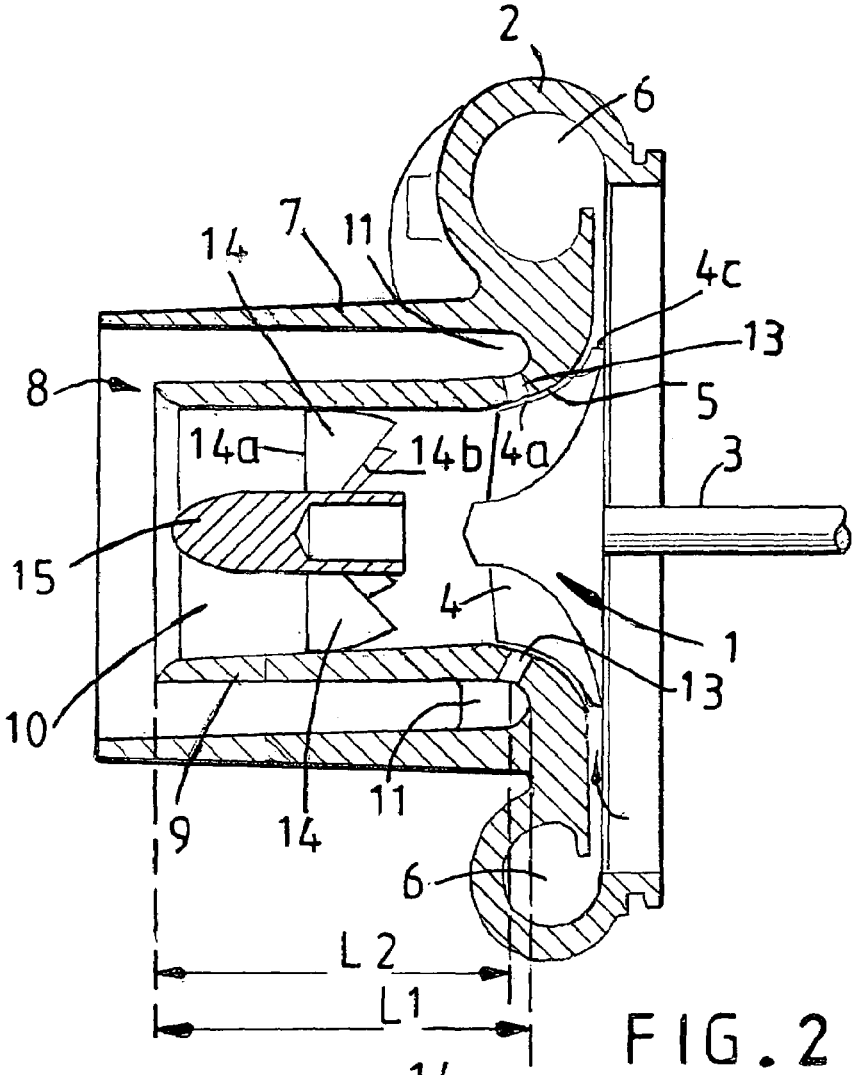
FIG. 2 is a cross-section through part of an MWE compressor including a fixed inlet guide vane system in accordance with a first embodiment of the present invention.
Figure 5A:
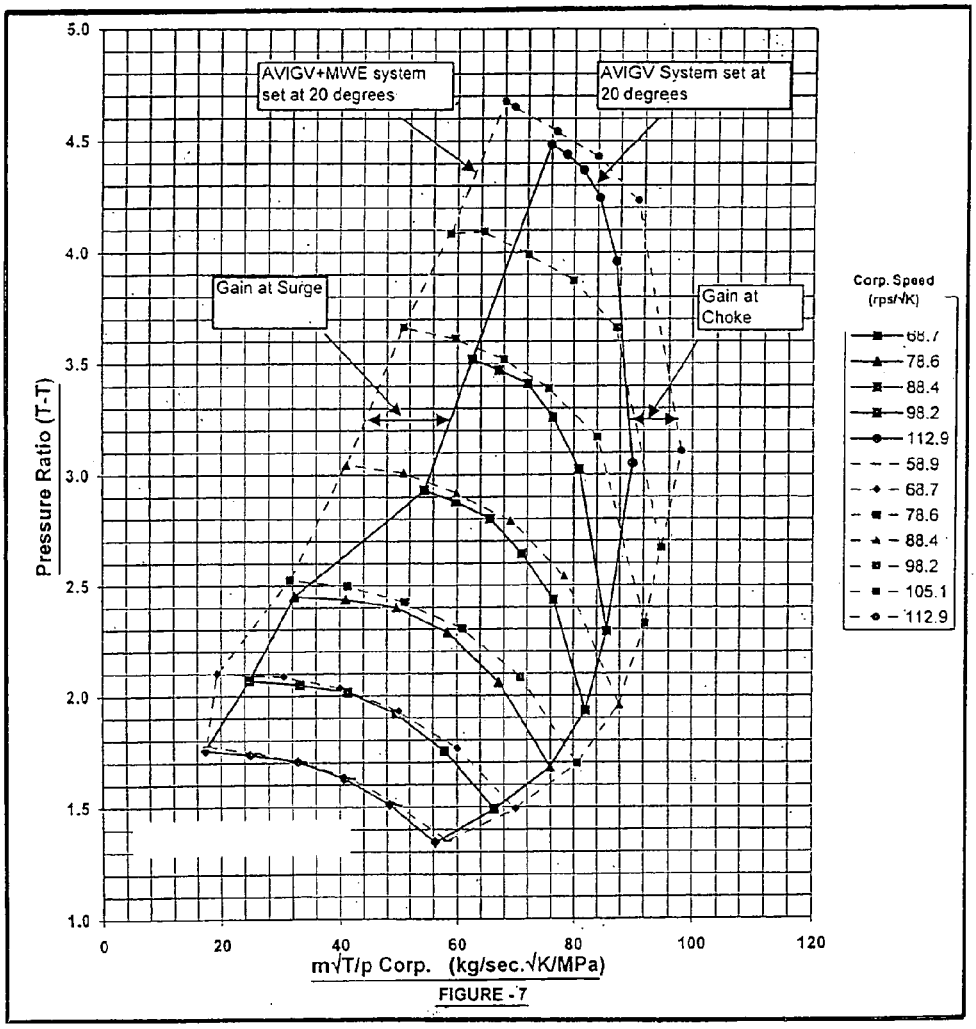
Figure 5B:
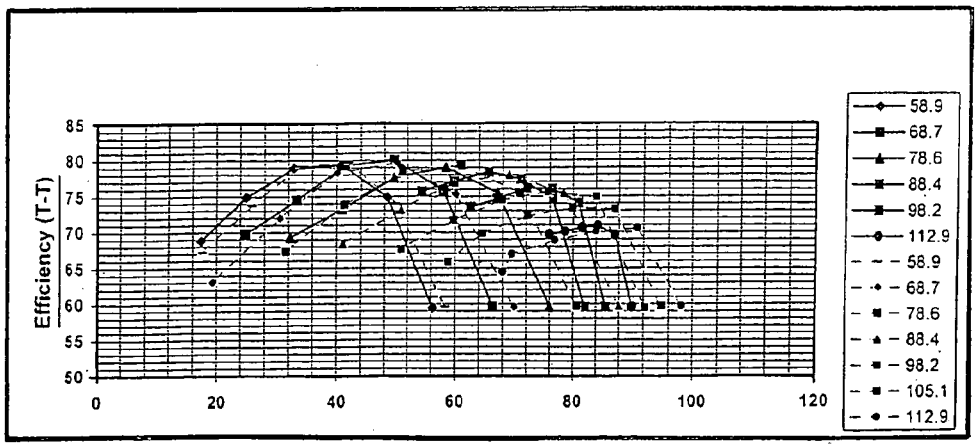
Figure 6A:
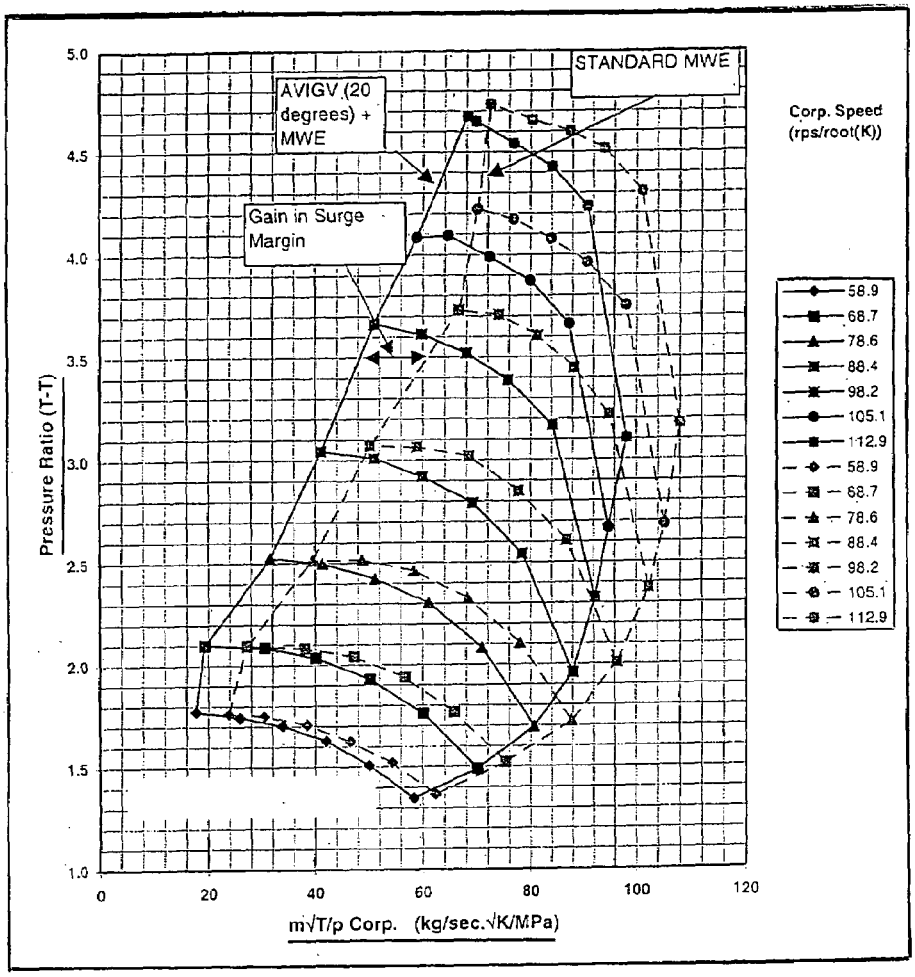
Figure 6B:
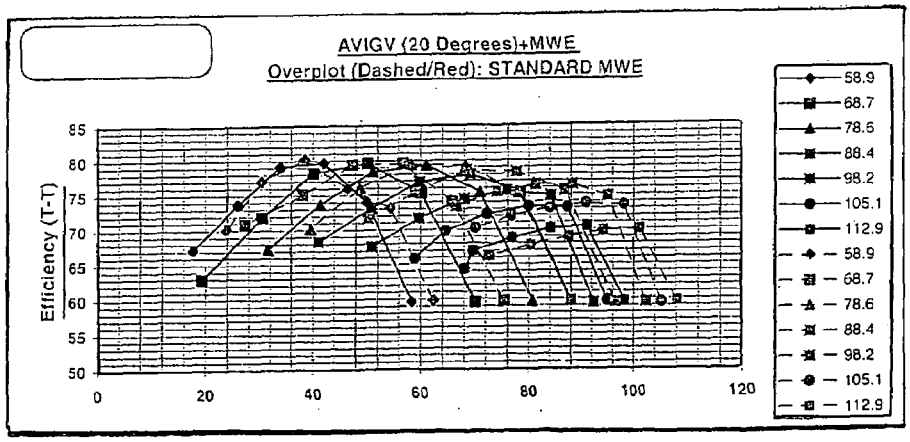
Figure 7A:
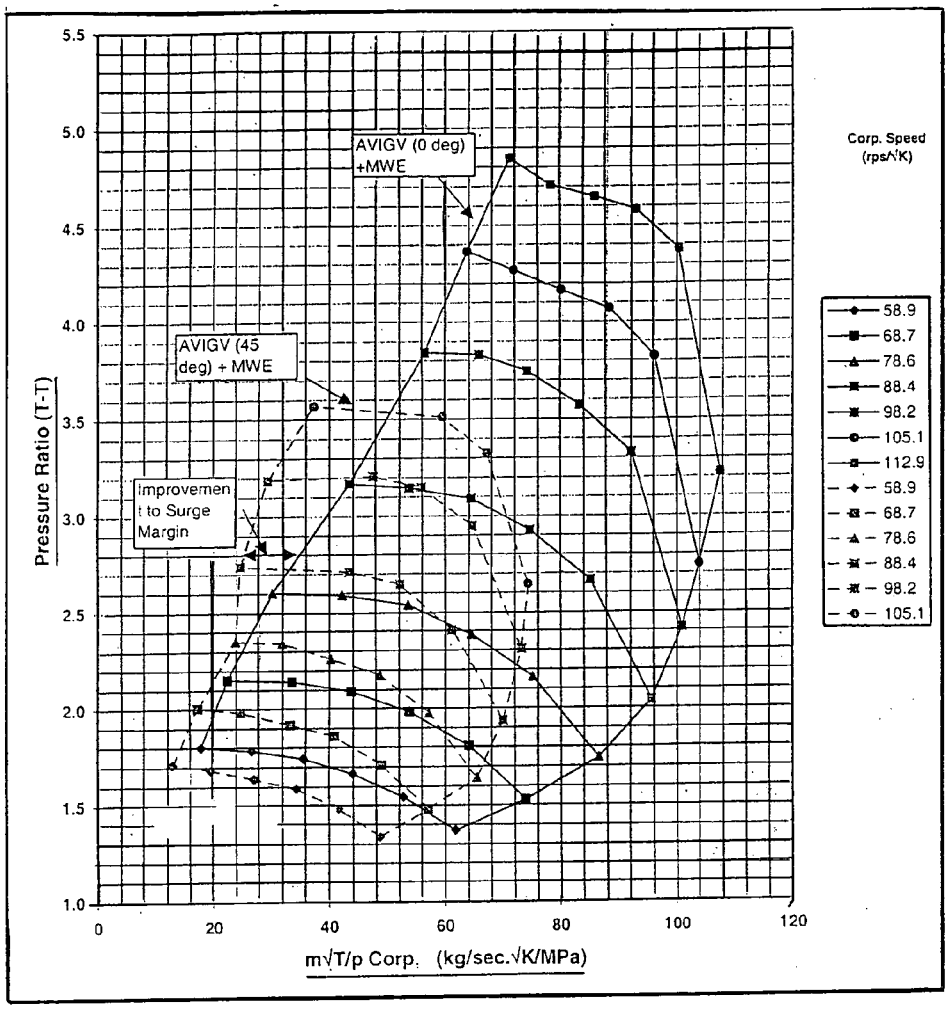
Figure 7B:
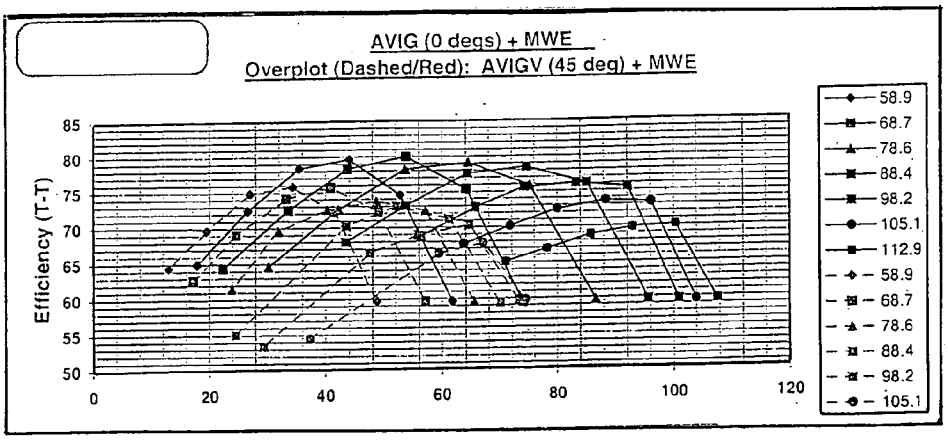

FIG. 5*a* is an over-plot comparing the map of a compressor according to the embodiment of FIG. 2 to the map of a non-MWE compressor fitted with an inlet guide vane system;

FIG. 5*b* is an over-plot of the efficiency of a compressor in accordance with the embodiment of FIG. 2 compared with the efficiency of a non-MWE compressor fitted with a similar guide vane system;

FIG. 6*a* is an over-plot comparing the map of a compressor according to the embodiment of FIG. 2 in comparison with the map of a standard MWE compressor without inlet guide vanes;

FIG. 6*b* is an over-plot of the efficiency of a turbocharger in accordance with the embodiment of FIG. 2 compared with the efficiency of a conventional MWE compressor;

FIG. 7*a* is an over-plot comparing the map of a compressor according to the present invention with inlet guide vanes swept forward at 45° to the map of a similar MWE compressor fitted with guide vanes set at 0°;

FIG. 7*b* is an over-plot of the efficiency of the compressors having the maps illustrated in FIG. 6*a;*

Figure 8:
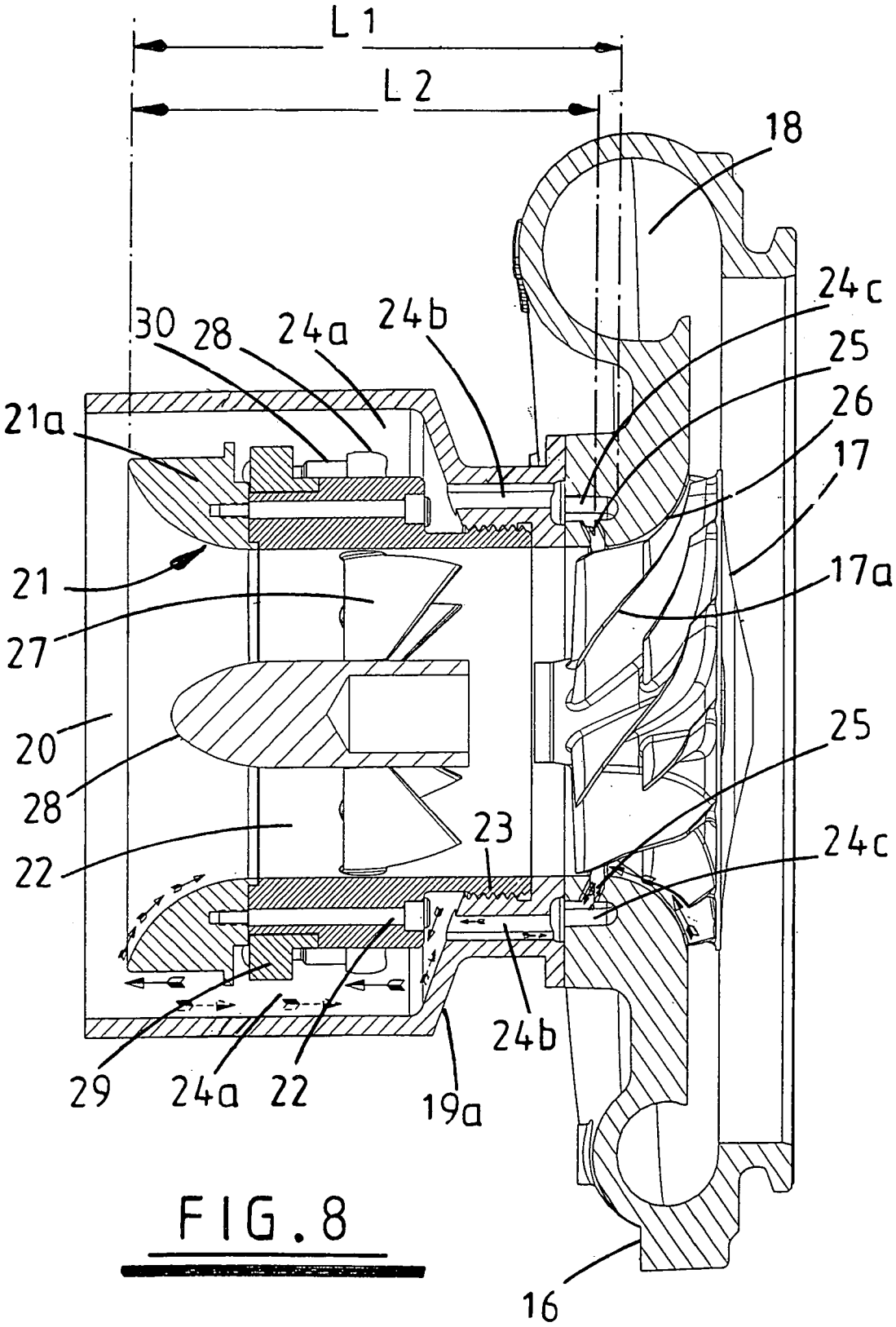
Figure 9A:
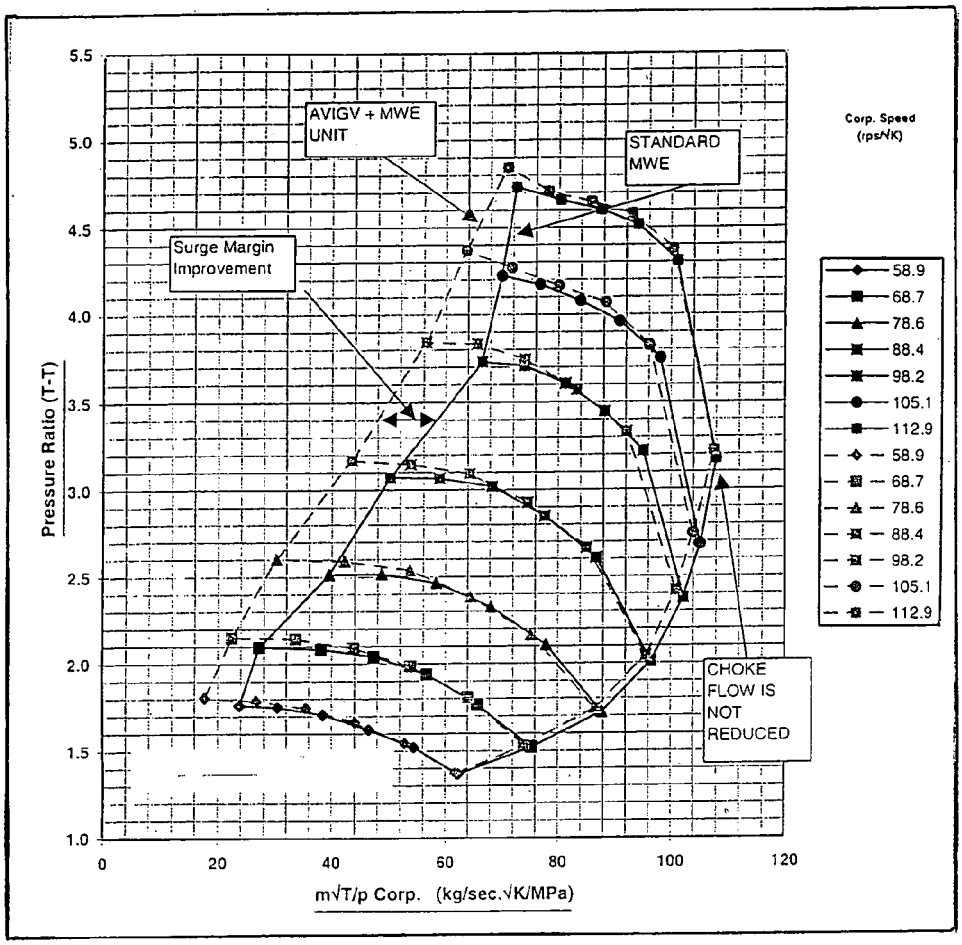
Figure 9B:
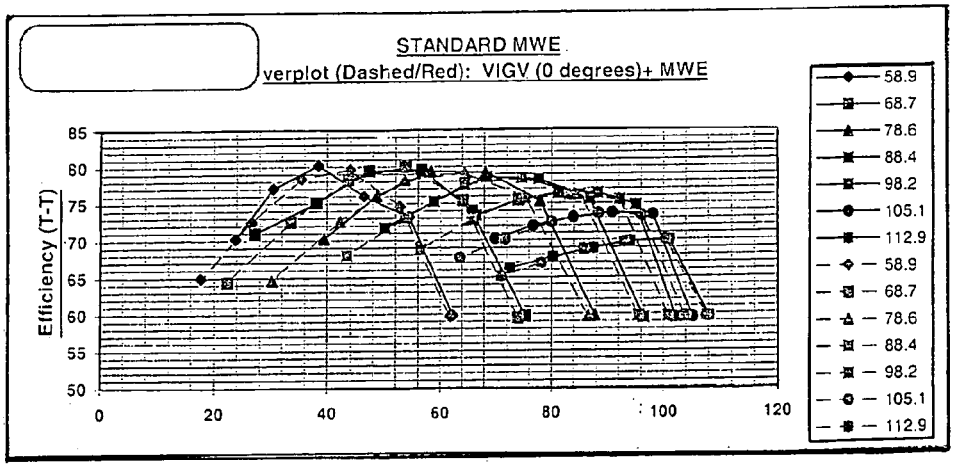

FIG. 8 is a cross-section through part of a MWE compressor including a variable inlet guide vane system in accordance with a second embodiment of the present invention;

FIG. 9*a* is an over-plot comparing the map of a compressor in accordance with the present invention with guide vanes set at a 0° angle compared to a standard MWE compressor; and FIG. 9*b* is an over-plot of the efficiency of the compressors having the maps illustrated in FIG. 9*a*.

Figure 1:
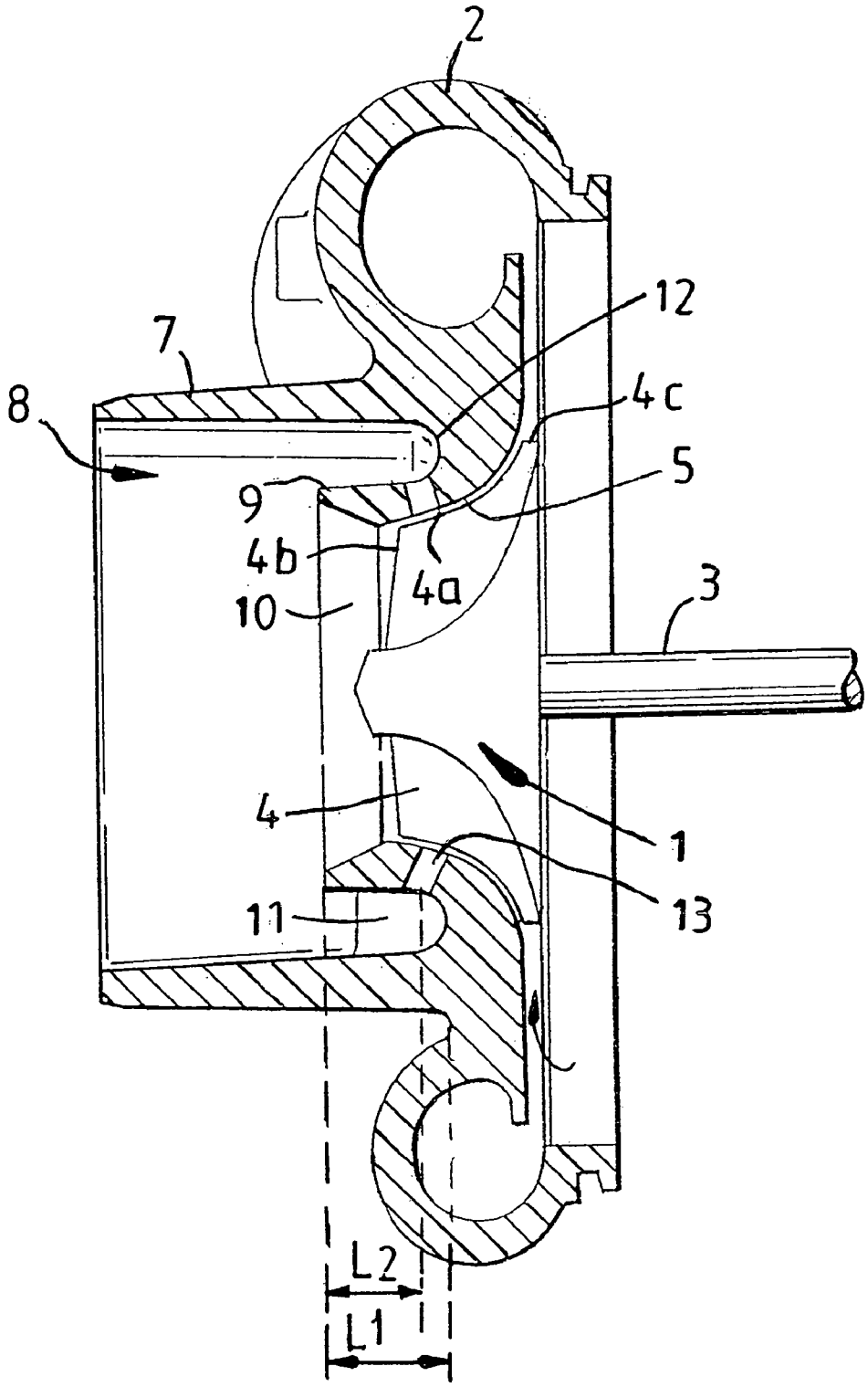
FIG. 1 (Prior Art)
FIG. 1 is a cross-section of part of a conventional MWE compressor.

Referring to FIG. 1 the illustrated MWE compressor comprises an impeller wheel 1 mounted within a compressor housing 2 on one end of a rotating shaft 3. The impeller wheel 1 has a plurality of blades (or vanes) 4 each of which has an outer edge 4*a* intermediate a leading edge 4*b* and a trailing edge 4*c*. The outer edges 4*a* of the blades 4 sweep across an inner housing surface 5 when the impeller wheel 1 rotates with the shaft 3. The compressor housing 2 defines an outlet volute 6 surrounding the impeller wheel, and an MWE inlet structure comprising an outer tubular wall 7 extending upstream of the impeller 1 and defining an intake 8 for gas such as air, and an inner tubular wall 9 which extends part way in to the intake 8 and defines the compressor inducer 10. The inner surface of the inner wall 9 is an upstream extension of the housing wall surface 5 which is swept by the outside edges 4*a* of the impeller blades 4.

An annular flow passage 11 surrounds the inducer 10 between the inner and outer walls 9 and 8 respectively. The flow passage 11 is open to the intake 8 at its upstream end and is closed at its downstream end by an annular wall 12 of the housing 2. The annular passage 11 however communicates with the impeller wheel 1 via apertures 13 formed through the housing and which communicate between a downstream portion of the annular flow passage 11 and the inner surface 5 of the housing 2 which is swept by the outer edges 4*a* of the impeller wheel blades 4.

The conventional MWE compressor illustrated in FIG. 1 operates as is described above in the introduction to this specification. In summary, when the flow rate through the compressor is high, air passes axially along the annular flow path 11 towards the impeller wheel 1, flowing to the impeller wheel 1 through the apertures 13. When the flow through the compressor is low, the direction of air flow through the annular flow passage 11 is reversed so that air passes from the impeller wheel, through the apertures 13, and through the annular flow passage 11 in an upstream direction and is reintroduced into the air intake 8 for re-circulation through the compressor. This stabilises the performance of the compressor improving both the compressor surge margin and choke flow.

Referring to FIG. 2, this illustrates a modification of the conventional MWE compressor of FIG. 1 in accordance with a first embodiment of the present invention. Components which correspond to those of the compressor of FIG. 1 are identified by the same reference numerals as used in FIG. 1. Thus, the illustrated compressor in accordance with the present invention comprises an impeller wheel 1 rotating within a compressor housing 2, outer edges 4*a* of the impeller wheel blades 4 sweeping across an inner surface 5 of the housing 2.

Figure 3:
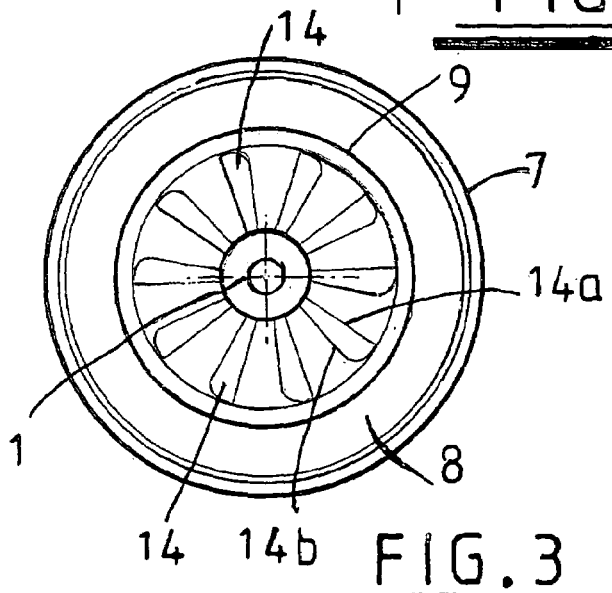
FIG. 3 is a front view of the inlet of the compressor of FIG. 2.

The outlet volute 6 is the same as that of the conventional MWE of FIG. 1, but the inlet structure is modified in accordance with the present invention. Specifically, the inner and outer tubular housing walls 9 and 8 are extended in an upstream direction to accommodate inclusion of an inlet guide vane system comprising a plurality of guide vanes 14 extending between a central nose cone 15 and the inner tubular wall 9. The guide vanes 14 are swept forward, relative to the rotational direction of the impeller wheel 1, to induce pre-whirl in the air flow to the compressor wheel. In the illustrated example, each guide vane 14 is substantially planar having a radial leading edge 14*a* and an angled trailing edge 14*b*, and extends in a downstream direction in a plane lying at an acute angle to a plane parallel to the axis of the impeller wheel 1 and passing through the respective vane leading edge 14*a*. This sweeping forward of the inlet guide vanes 14 can best be appreciated from FIG. 3 which is a front view of the inlet of the compressor of FIG. 2. In the particular embodiment illustrated, the inlet guide vanes 14 are swept forward at an angle of 20°.

The provision of axial inlet guide vanes is a known expedient to extend a non-MWE compressors operational range. Known guide vane systems include fixed guide vane systems and variable guide vane systems in which the angle at which the guide vanes are swept forward can be adjusted. The pre-whirl induced by the guide vanes at the compressor inlet improves the surge margin of the compressor, i.e. reduces the flow at which the compressor surges. This can be seen from FIG. 4 which is an over-plot of the map of a non-MWE compressor fitted with a variable inlet guide vane system (not illustrated) with the vanes set at 0° (inducing no swirl) and 20° respectively.

Figure 4:
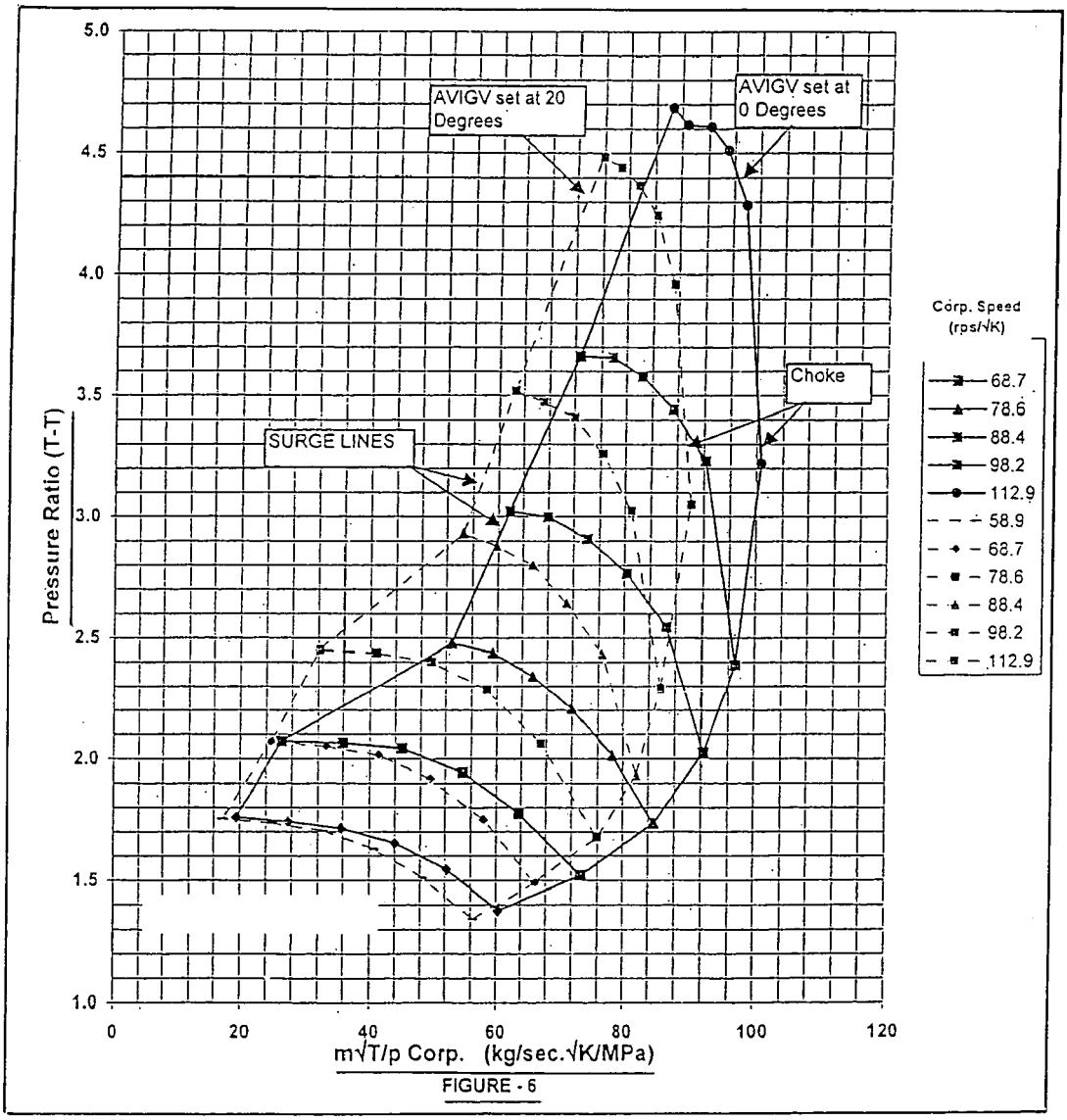
FIG. 4 is an over-plot of the compressor map of a non-MWE compressor fitted with a variable inlet guide vane system with guide vanes set at angles of 0° and 20° respectively.

As is well known, the compressor map plots air flow rate through the compressor against the pressure ratio from the compressor inlet to outlet for a variety of impeller rotational speeds. The left hand line of the map represents the flow rates at which the compressor will surge for various turbocharger speeds and is known as the surge line. In FIG. 4 the map of the compressor fitted with guide vanes set at 20° to induce pre-swirl is shown in dotted line. It can clearly be seen that the flow at which the compressor surges is reduced for all operating speeds as compared with a 0°, no pre-swirl, setting of the vanes. However, FIG. 4 also illustrates the well known un-desirable effects of inducing pre-whirl in the compressor inlet, namely a reduction in the compressor pressure ratio capability (the highest point of the map) and also a reduction in maximum air flow, known as choke flow, as represented by the right hand line of the map. Indeed, the reduction in choke flow generally exceeds the improvement in surge margin so that there is an overall narrowing of the width of the compressor map.

However, the present inventors have found that the installation of an inlet guide vane system in an MWE compressor can provide a further improvement in the surge margin compared with a conventional MWE compressor together with an improvement in compressor pressure ratio capability or choke flow compared with a non-MWE compressor fitted with similar guide vanes, provided the guide vanes are installed within the compressor inducer downstream of the point of reintroduction of air returned from the compressor wheel into the compressor intake. This is illustrated by FIGS. 5 and 6.

Referring first to FIG. 5, this is an over-plot of the map of the compressor of FIG. 2 (shown in dotted lines) in comparison with the map of a non-MWE compressor fitted with a guide vane system corresponding to the guide vane system of FIG. 2 in which guide vanes extend at 20° to induce pre-whirl (i.e. the map shown in dotted lines in FIG. 4). This shows that the present invention provides a significant increase in surge margin compared with a non-MWE compressor fitted with guide vanes, together with an increase in both compressor pressure ratio capability and choke flow.

FIG. 5*a* is an over-plot of the efficiency of the compressors having the maps plotted in FIG. 5*a*. This clearly shows that there is no significant loss in efficiency, and even an increase in efficiency in some cases, associated with the addition of the inlet guide vane system to the MWE compressor.

Referring to FIG. 6*a*, this is an over-plot of the map of the compressor of FIG. 2 (in this case shown in solid lines) in comparison with the map of a standard MWE compressor without inlet guide vanes (shown in dotted lines). This illustrates that whilst addition of a fixed guide vane system to an MWE compressor improves surge margin at the expense of choke flow, the overall width of the map is not substantially affected. In other words, the reduction in choke flow, and the reduction in pressure ratio capability, is not as marked as is the case of a non-MWE compressor.

FIG. 6*b* is an over-plot of the efficiency of the compressors having the maps plotted in FIG. 6*a*, again showing that there is no significant loss in efficiency associated with implementation of the present invention.

If the angle of the inlet guide vanes is increased, the negative effect on the choke flow also increases. This illustrated by FIG. 7*a* which is an over-plot of the map of a compressor in accordance with the present invention fitted with guide inlet vanes swept forward at a 45° angle (shown in dotted line) in comparison with a similar MWE compressor system fitted with inlet guide vanes set at a 0° angle (shown in solid lines). This shows significant loss in choke flow as the amount of pre-swirl is increased. In addition, FIG. 7*b* which plots the efficiency of the two compressors shows a similar reduction in efficiency.

The embodiment of the invention described in FIG. 2 is a relatively simple fixed inlet guide vane system to demonstrate how the benefits of the present invention can be obtained by minimum modification of a conventional MWE compressor such as shown in FIG. 1. It is, however, preferred that the inlet guide vanes are adjustable to vary the degree of pre-swirl to suit different operating conditions to maximise the benefits of increased surge margin and minimise any loss in choke flow. An embodiment of the present invention comprising an adjustable or variable inlet vane guide system is illustrated in part cross section in FIG. 8.

Referring to FIG. 8, the illustrated compressor has a modular housing comprising an exducer portion 16 housing the impeller wheel 17 and defining the outlet volute 18 and an inlet portion comprising an outer tubular wall 19 defining the intake portion 20 of the compressor, and an inner tubular wall 21 defining the inducer portion 22 of the compressor. In fact, the inner tubular wall 21 is itself a two-part component including a outwardly flared inlet cone 21*a* bolted to the main part of tubular portion 21 via bolts 22. The outer tubular inlet portion 19 is bolted to the exducer portion 16 of the compressor housing and is outwardly flared at region 19*a* to accommodate a variable inlet guide vane actuating mechanism to be described.

The inner tubular wall member 21 is secured into the outer tubular wall member 19 via screw threaded engagement indicated at 23. An annular flow passage is formed around the inner wall member 21 which has three axial portion, namely an upstream axial portion 24*a*, an intermediate axial portion 24*b* defined through and a downstream axial portion 24*c* formed within the exducer portion 16 of the compressor housing. Apertures 25 provide communication between the annular passage 24 and an inner surface 26 of the exducer portion 16 of the compressor housing which is swept by edges of impeller blades 17*a*.

The inlet guide vane system is similar to that illustrated in FIG. 2 comprising a plurality of guide vanes 27 extending between a central nose cone 28 and the inner tubular wall section 21 downstream of the point where the annular gas flow passage 24 opens into the intake 20 of the inlet. However, in this case each inlet vane 27 is pivotable about a stem 28 which extends radially through the inner wall member 21 so that each vane is pivotable about a radial axis lying adjacent the vanes leading edge. The end of each vane stem which extends radially from the inner wall member 21 is linked to a common actuating ring 29 via a respective connecting arm 30. The arrangement is such that rotation of the actuating ring about the inner wall 21 simultaneously pivots all of the guide vanes 27 on their respective stems 28 to vary the angle at which the guide vanes 27 are swept forward relative to the rotational direction of the impeller wheel 17. This basic type of variable or adjustable inlet guide vane system is known and allows appropriate adjustment of the degree of pre-swirl induced in the gas flowing into the impeller.

Aside from the construction, and operation, of the variable guide vane system, operation of the embodiment of FIG. 8 is essentially the same as that of FIG. 2 in terms of improvements to the performance of the compressor. In fact, the inventors have found that with the embodiments of the present invention provided with variable inlet guide vane systems, setting the guide vane angle to 0° provides some improvement in surge margin in comparison with a standard MWE compressor, without any significant reduction in choke flow. This is illustrated by FIG. 9 which is an over-plot of a compressor in accordance with the present invention with a 0° vane angle (shown in dotted lines) in comparison with a conventional MWE compressor as illustrated in FIG. 1 (shown in solid lines). In this instance the improvement in surge margin is thought to be due at least in part to the increased length of the inner tubular wall (member 21 of FIG. 6) in comparison with the conventional MWE inlet arrangement.

Referring again to FIGS. 1, 2 and 6, in each case the annular flow passage 11/24 has an overall axial length L1 defined between its upstream end (defined where the passage opens to the inlet) and its downstream end (the axially inner most point of the passage). The annular passage also has an axial length L2 defined between its upstream end and the axial location of the apertures 13/25, which corresponds to the axial length of the portion of the inner tubular wall 9/21 extending upstream of the apertures 13/25. With the embodiments of the present invention it can be seen that the lengths L1 and L2 are extended in comparison with the corresponding dimensions of the conventional MWE turbocharger illustrated in FIG. 1. Specifically, the present inventors have found that extending the length of the annular passage to the extent that L1/D is >0.65 and/or L2/D is >0.6, where D is the internal diameter of the inner tubular wall, increases the surge margin of the compressor significantly. In particular, the dimension L2/D is thought to be most significant as this is the effective length of annular passage 11/24 through which gas flows at surge.

It will be appreciated that the exact structure of the compressor housing, and guide vane system, may vary considerably from the embodiments described above. What is important is that guide vanes are provided for inducing pre-swirl in the inlet downstream from the point at which air flow recirculated from the impeller is reintroduced into the inlet. Accordingly, possible modifications and alternative configurations to those described above will be readily appreciated by the skilled person.

It will be appreciated that the inlet need not be straight but could have one or more bends. In other words, the inner and outer tubular walls may have portions having axis that curve away from the rotational axis of the impeller. In determining the optimum dimensions L1/D and L2/D for such curved inlets, the respective lengths are measured along the axis of the tubular portions (which may comprise both straight and curved portions). Where the diameter of the inner tubular wall varies, the diameter D is preferably taken as the downstream diameter of the inner tubular wall.

It will also be appreciated that the annular flow passage defined around the inner tubular portion of the inlet may include radially extending walls or baffles and other design expedients known to reduce noise generation.

It will also be appreciated that compressors in accordance with the present invention may have a variety of applications. One such application is as the compressor stage of a combustion engine turbocharger in which case the compressor wheel will be mounted on one end of a turbocharger shaft as is known in the art. Accordingly, the compressor housing may be adapted for connection to a bearing housing in a conventional way. Other possible applications of the invention will be readily apparent to the appropriately skilled person.

The invention claimed is:

1. A compressor for compressing a gas, the compressor comprising:

a housing defining an inlet and an outlet; an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises: an outer tubular wall extending away from the impeller wheel in an upstream direction and forming a gas intake portion of the inlet;

an inner tubular wall extending away from the impeller wheel in an upstream direction within the outer tubular wall and defining an inducer portion of the inlet;

an annular gas flow passage defined between the inner and outer tubular walls;

at least one downstream aperture communicating between a downstream portion of the annular gas flow passage and said surface of the housing swept by the impeller vanes;

at least one upstream aperture communicating between an upstream portion of the annular flow passage and the inducer or intake portions of the inlet; and a plurality of inlet guide vanes mounted within the inducer portion of the inlet downstream of said at least one upstream aperture to induce pre-swirl in gas flowing through the inducer portion of the inlet.

2. A compressor according to claim 1, wherein the annular gas flow passage is open at its upstream end so that said at least one upstream aperture is an annular opening defined at the upstream end of the inner tubular wall.

3. A compressor according to claim 1, wherein the inlet guide vanes are supported by the inner tubular wall.

4. A compressor according to claim 3, wherein the inlet guide vanes are each supported between the inner tubular wall and a central nose portion lying along the axis of the compressor.

5. A compressor according to claim 1, wherein the inlet guide vanes are adjustable to selectively vary the degree of pre-swirl induced in the gas flowing through the inducer.

6. A compressor according to claim 5, wherein each inlet guide vane is pivotable about a radial axis to vary the angle of the vane relative to a plane parallel to the axis of the compressor to vary the degree of pre-swirl.

7. A compressor according to claim 6, wherein each vane is mounted on a respective radial stem which extends through the inner tubular wall, and an actuator is provided for rotating each vane stem to thereby pivot the respective vane.

8. A compressor according to claim 7, wherein said actuator comprises an annular member disposed around the inner tubular wall and connected to each of the inlet guide vane stems via a respective connecting arm, whereby rotational movement of the annular member about the inner tubular wall is transmitted to each inlet guide vane stem to simultaneously adjust the angle of each guide vane.

9. A compressor according to claim 1, wherein said annular gas flow passage has a length L1 measured along its axis between its upstream and downstream ends, the inner tubular wall extending upstream of said at least one downstream aperture by a length L2 measured along its axis, and wherein L1/D is >0.65 and/or L2/D is >0.6, where D is a diameter of the inner tubular wall.

10. A compressor according to claim 9, wherein the lengths L1 and L2 are either entirely straight or at least in part curved.

11. A compressor according to claim 1, wherein the inner tubular wall and the annular passage are co-axial having an axis which is a continuation of the impeller wheel axis.

12. A compressor according to claim 1, wherein the inner tubular wall screws into an annular socket defined by said outer tubular wall.

13. A compressor according to claim 1, wherein the outer tubular wall is secured by a connection device to an exducer portion of the compressor housing.

14. A turbocharger comprising a compressor said compressor comprising:

a housing defining an inlet and an outlet;

an impeller wheel including a plurality of vanes rotatably mounted within the housing;

the housing having an inner wall defining a surface located in close proximity to radially outer edges of impeller vanes which sweep across said surface as the impeller wheel rotates about its axis;

wherein the inlet comprises:

an outer tubular wall extending away from the impeller wheel in an upstream direction and forming a gas intake portion of the inlet;

an inner tubular wall extending away from the impeller wheel in an upstream direction within the outer tubular wall and defining an inducer portion of the inlet;

an annular gas flow passage defined between the inner and outer tubular walls;

at least one downstream aperture communicating between a downstream portion of the annular gas flow passage and said surface of the housing swept by the impeller vanes;

at least one upstream aperture communicating between an upstream portion of the annular flow passage and the inducer or intake portions of the inlet; and a plurality of inlet guide vanes mounted within the inducer portion of the inlet downstream of said at least one upstream aperture to induce pre-swirl in gas flowing through the inducer portion of the inlet.

* * * * *